United States Patent [19]

Ventimiglia

[11] Patent Number: 5,018,649

[45] Date of Patent: May 28, 1991

[54] PORTABLE MANNEQUIN WITH IMPROVED DISPLAY FEATURES

[76] Inventor: Peter G. Ventimiglia, 19000 Lister, East Detroit, Mich. 48021

[21] Appl. No.: 476,866

[22] Filed: Feb. 8, 1990

Related U.S. Application Data

[63] Continuation-in-part of Ser. No. 238,331, Aug. 29, 1988, Pat. No. 4,917,278.

[51] Int. Cl.[5] ..... A47F 8/00; A47F 8/02; A47H 5/00; A47G 25/20

[52] U.S. Cl. ..... 223/68; 223/85; 223/88; 223/89; 223/94

[58] Field of Search ..... 223/85, 88, 89, 92, 223/94, 66, 68, 69; 211/113, 118

[56] References Cited

U.S. PATENT DOCUMENTS

| | | | |
|---|---|---|---|
| 1,156,246 | 10/1915 | Moschcowitz | 223/68 |
| 1,158,358 | 10/1915 | Wordingham | 223/92 |
| 1,184,724 | 5/1916 | Conner et al. | 223/68 |
| 1,206,470 | 11/1916 | Rosen | 223/92 |
| 1,254,719 | 1/1918 | Moschcowitz | 223/68 |
| 1,289,658 | 12/1918 | Chilstrom | 223/94 |
| 1,482,253 | 1/1924 | Perrine | 223/92 |
| 2,303,585 | 5/1941 | Shafarman | 223/68 |
| 2,536,187 | 7/1951 | Kosky | 223/92 |
| 2,666,554 | 1/1954 | Wexler | 223/92 X |
| 2,796,206 | 6/1957 | Schwartz | 223/68 |
| 2,902,192 | 9/1959 | Ericson | 223/68 |
| 2,998,903 | 9/1961 | Day | 223/92 |
| 4,109,838 | 8/1978 | Dwek | 223/91 |
| 4,805,816 | 2/1989 | Freund | 223/66 |
| 4,917,278 | 4/1990 | Ventimiglia | 223/68 |

*Primary Examiner*—Werner H. Schroeder
*Assistant Examiner*—Bibhu Mohanty
*Attorney, Agent, or Firm*—Dykema Gossett

[57] ABSTRACT

There is disclosed a portable mannequin which is both collapsible and attachable to a coat hanger. The mannequin includes a frame member having a bent upper portion, a hoop pivotally mounted to said frame member, and a hoop extension member connected at one end to said hoop and slideably connected at the other end to said frame member and having friction-producing member in the form of a tubular member provided over said frame member to provide friction between said hoop extension member and said frame member.

13 Claims, 4 Drawing Sheets

Fig-10
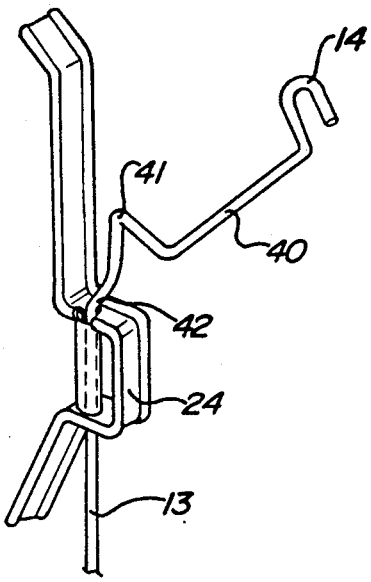
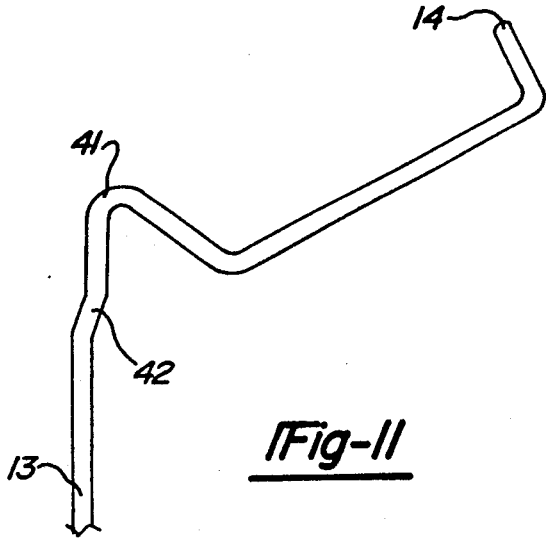
Fig-11
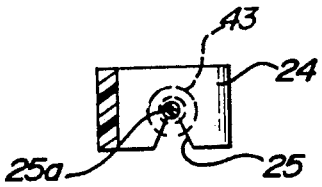
Fig-13
Fig-12
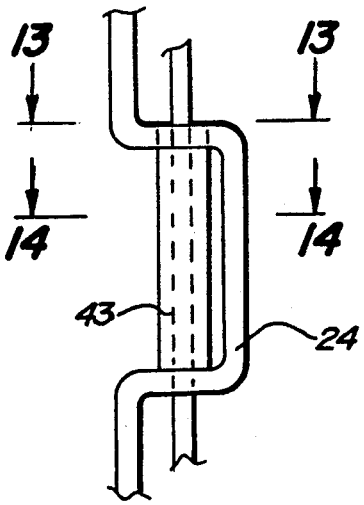
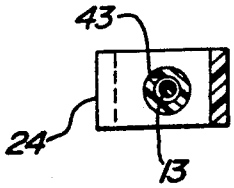
Fig-14

PORTABLE MANNEQUIN WITH IMPROVED DISPLAY FEATURES

This is a continuation-in-part of copending application Ser. No. 07/238,331 filed on Aug. 29, 1988 now U.S. Pat. No. 4,917,278.

BACKGROUND OF THE INVENTION

1. Field of the Invention

The present invention relates to portable display devices, and more particularly to portable display devices for displaying wedding gowns, dresses, suits and the like.

2. Description of the Prior Art

It has long been the practice in the retailing of better dresses, and in particular, wedding gowns, as well as in the sale of men's suits and the like, to display such items in a manner as they might appear when worn by the purchaser. Such display typically takes place in the show window or on the sales floor of a retail store, and involves, in essence, "dressing" a mannequin or display dummy as the purchaser of the item might dress, in order that the clothing item be displayed in an attractive fashion.

However, the cost of making a life-sized mannequin is relatively large, limiting the number of such mannequins the typical smaller retailer could afford to use, and thus limiting his means of displaying his wares. Thus, the search has long been on for a less costly manner of displaying dresses, suits and the like, and many attempts have been made in the art to make the full-sized mannequins less costly to manufacture.

Other attempts, such as those discussed in the statement of patentability accompanying this application, deal with attempts to make portable mannequins of various types which may be either stored in a collapsed position, so as not to occupy the space of full-sized mannequins, or have involved various attachments to coat hangers to provide a mannequin-like structure when needed. However, up until the present invention, there has been nothing which is both collapsible and attachable to a coat hanger to provide both advantages.

SUMMARY OF THE INVENTION

In order to provide a portable mannequin which is both collapsible and attachable to a coat hanger, I have provided a frame member, a hoop pivotally mounted to said frame member and an extension connected at one end to said hoop and slideably connected at the other end to said frame member so that by moving the hoop extension up and down on said frame member, a hoop may be moved from the vertical position to the horizontal position.

Thus, it is an object of the present invention to provide a portable mannequin which may be attachable to a clothes hanger having a garment hung thereon, remain in its collapsed state until it is desired to show the garment to a prospective purchaser and then may be extended to simulate a male or female form.

It is a further object of the present invention to make a lightweight portable mannequin which may be attached to a coat hanger or other device for displaying garments.

It is a further object of the present invention to provide a portable mannequin which is both collapsible and attachable to a coat hanger.

It is a still further object of the present invention to make a portable mannequin of the foregoing nature which is relatively simple and inexpensive to manufacture.

Further objects and advantages of the present invention will be apparent from the following description and appended claims, reference being made to the accompanying drawings forming a part of the specification, wherein like reference characters designate corresponding parts in the several views.

BRIEF DESCRIPTION OF THE DRAWINGS

FIG. 10 is a partial perspective view showing a modification of my invention wherein the top of the frame member 13 is bent forward.

FIG. 11 is an elevational view of the portion of the frame member shown in FIG. 10.

FIG. 12 is an elevational view, showing a modification of my invention wherein a friction member is provided on a portion of the frame member.

FIG. 13 is a sectional view, taken in the direction of the arrows, along the section line 13—13 of FIG. 12.

FIG. 14 is a sectional view, taken in the direction of the arrows, along the section line 14—14 of FIG. 12.

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DESCRIPTION OF THE PREFERRED EMBODIMENT

Figure 1:
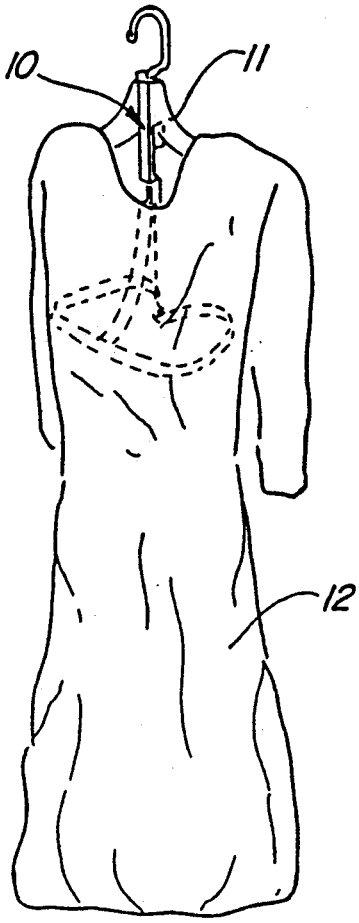
FIG. 1 is a perspective view from the rear showing a construction embodying my invention attached to a coat hanger having a dress thereon and being in its expended position to simulate the dress being worn on the female figure.
Figure 2:
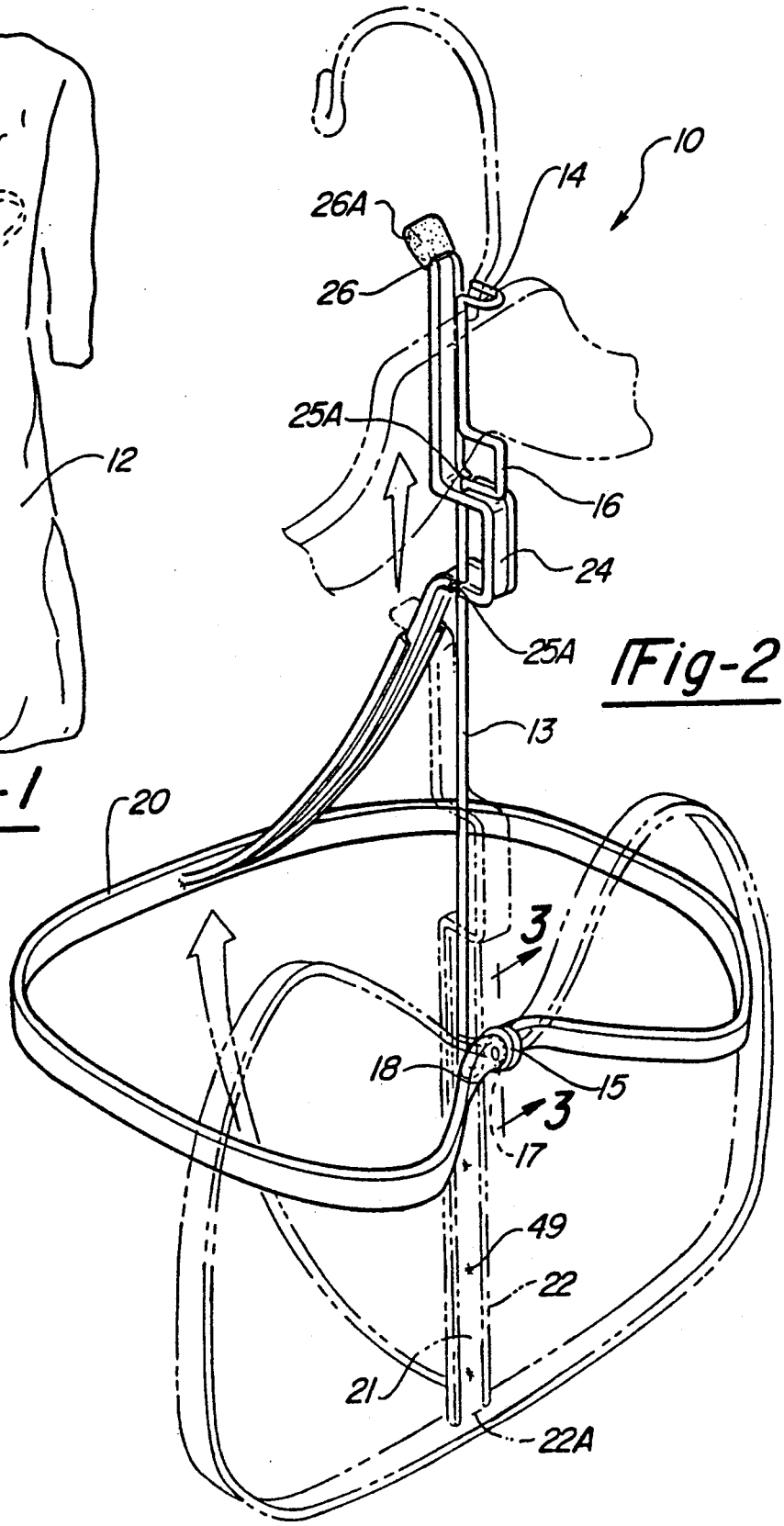
FIG. 2 is an exploded perspective view showing a construction embodying the present invention and showing how the hoop portion thereof may be positioned by the operation of the hoop extension.

Referring now to FIG. 1, there is shown my portable mannequin, generally designated by the numeral 10, attached to a coat hanger 11 and being opened to its expanded form so that the dress 12 may appear as it would when worn by the purchaser of the dress. As seen in FIG. 2, my portable mannequin 10 includes a frame member 13 having a hook means 14 at one end thereof, and an eye 15 at the other end thereof, with a stop means 16 intermediate the hook means 14 and the eye 15. The eye 15 snaps into a recess 17 in the thickened portion 18 of the hoop 20.

Figure 3:
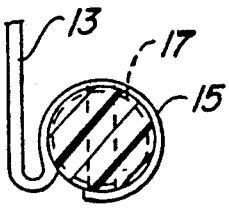
FIG. 3 is a sectional view, taken in the direction of the arrows along the section line 3—3 of FIG. 2.
Figure 9:
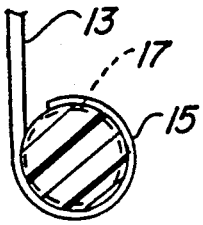
FIG. 9 is a modification of the construction shown in FIG. 3.
Figure 4:
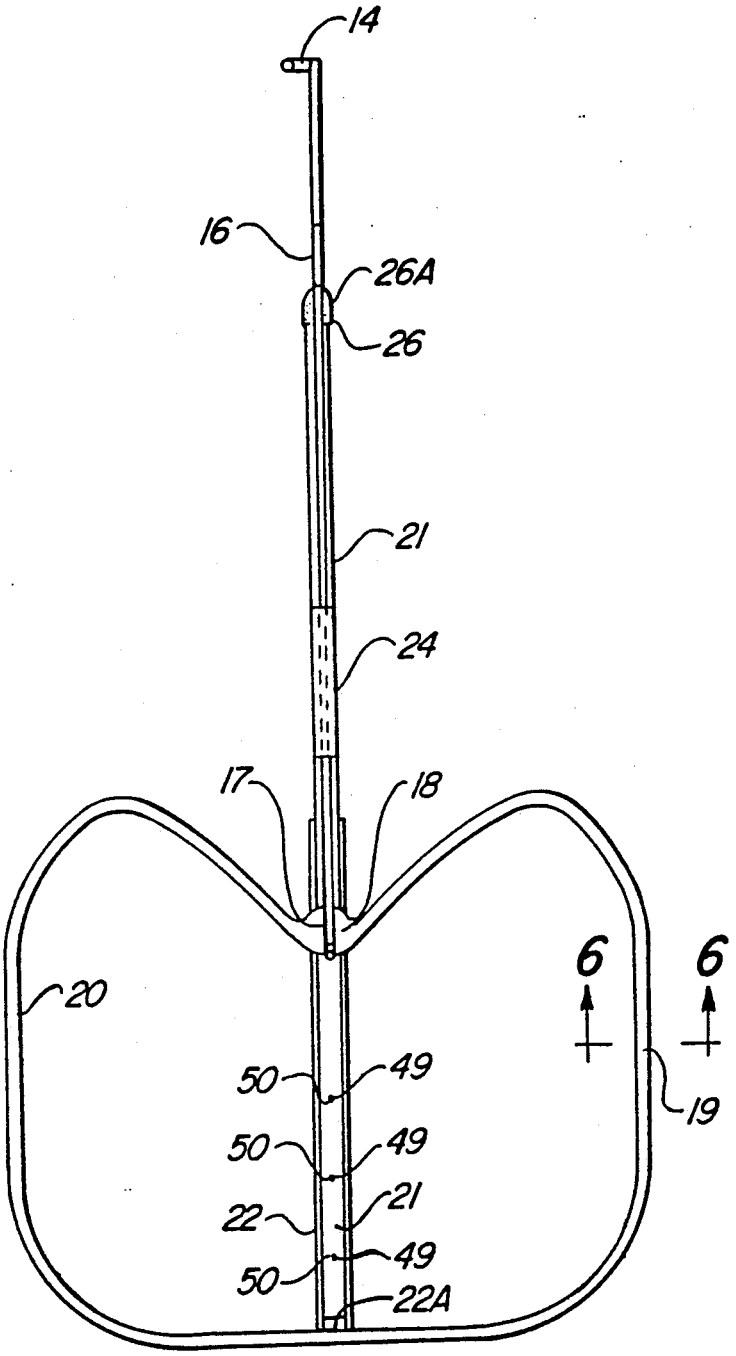
FIG. 4 is a front elevational view of the construction shown in FIG. 2.
Figure 5:
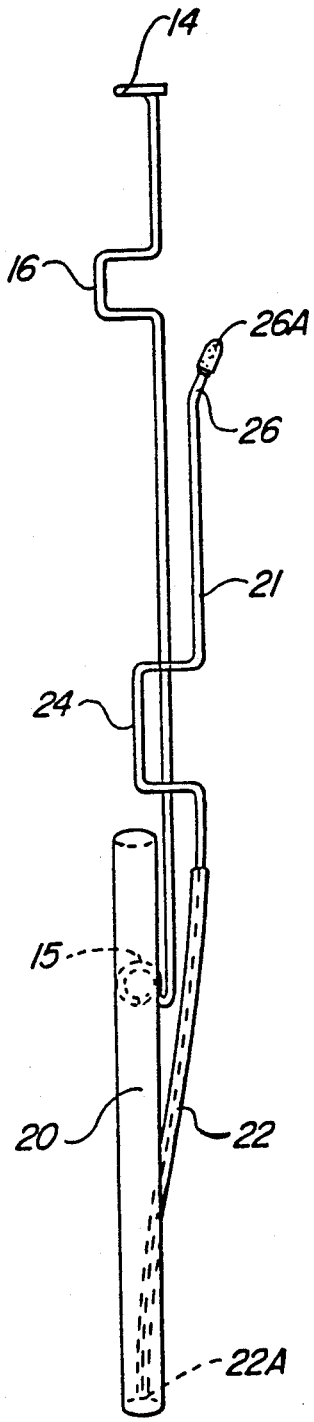
FIG. 5 is a side elevational view of the construction shown in FIG. 2.

As can be seen by referring to FIGS. 3 and 9, the eye 15 may be formed in either direction.

Figure 6:
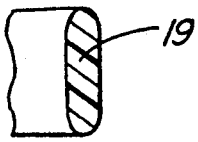
FIG. 6 is a sectional view, taken in the direction of the arrows, along the section line 6—6 of FIG. 4.

As can be seen by referring to FIG. 6, the open portion of the eye 15 can be placed over the hoop at the normal cross-section as shown at numeral 19, be slid around the hoop, and snapped into the recess 17.

The hoop 20 has an extension member 21 attached to the body of the hoop by hinge 22. In the preferred embodiment, this hinge 22 may be attached to hoop 20 by means of a living hinge formed proximate the middle of the hoop, as shown at numeral 22A. The hoop 20 and the hinge 22 are preferably, therefore, made of the same material and should be somewhat flexible.

The extension member 21 may be mounted to the hinge 22 by providing one or more nibs 49 thereon which fit into corresponding openings 50 provided in the hinge, and then are deformed by the application of heat to hold the extension member 21 firmly in place.

Formed in the extension member 21 (FIG. 8) is a deformed portion 24 having a pair of axially aligned openings 25 therein by which the extension portion 21 may slide up and down on the frame member 13. A tab 26 may be provided on the extremity of the extension member 21 for ease of movement. The tab 26 may be covered by a cap 26A, if desired.

Figure 8:
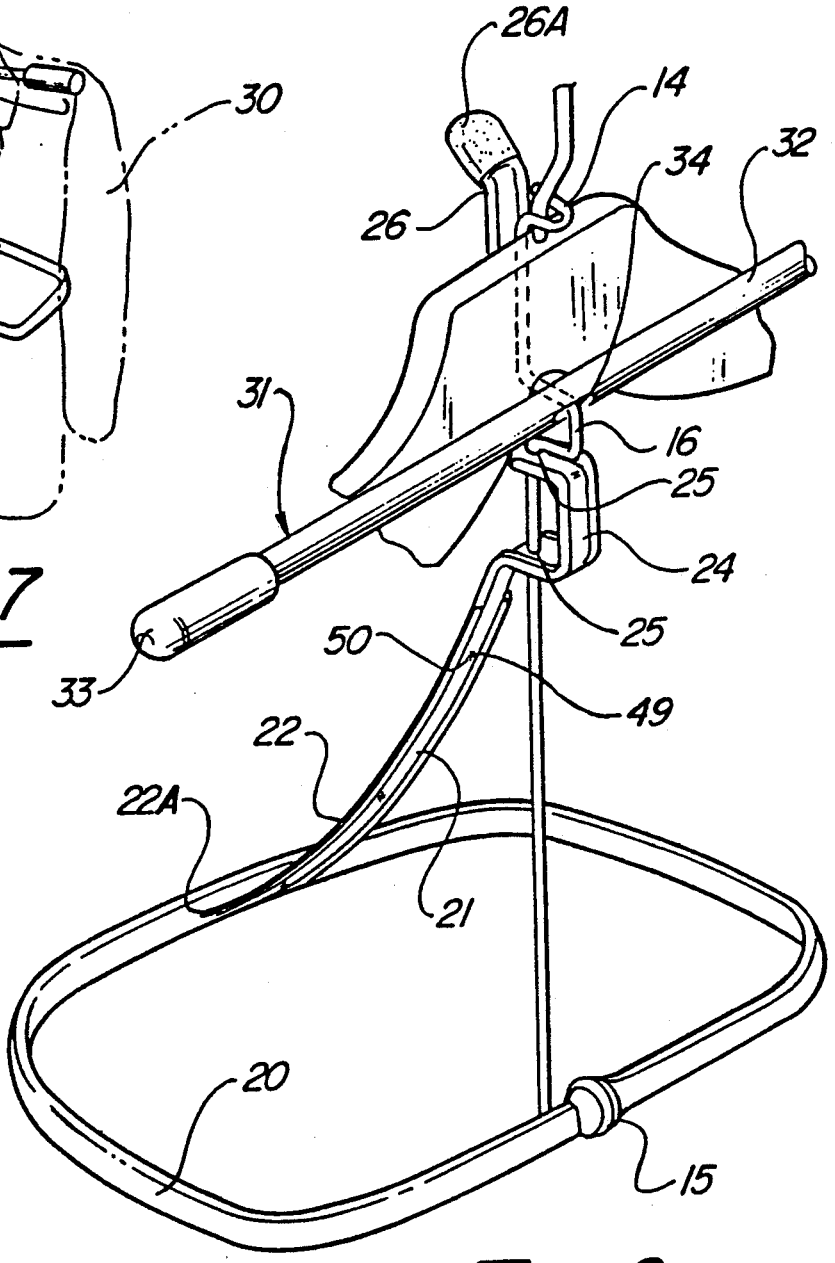
FIG. 8 is a view similar to FIG. 2, showing the hoop portion in an extended position, and showing a shoulder attachment which may be used either as shown, or with the version of my invention shown in FIG. 1.

In the embodiment shown in FIG. 8, the extension 21 is made of what is known in the art as millinery bone, which is an extruded plastic having wires embedded at each side thereof. For this reason, the axially aligned openings 25 must be separately provided in the millinery bone, which may complicate the assembly of my improved portable mannequin. In the version shown in FIG. 2, it can be seen that notches 25A are provided in the molded extension 21, which in this case is of a suitable all-plastic material, and thus separate openings 25 do not have to be provided, and the assembly of my portable mannequin is simplified.

To provide additional reinforcement, a separate plastic reinforcing strip (not shown) may be placed over the assembly of the hinge 22 and extension member 21 before the nibs 49 are deformed, thus providing additional reinforcement and stiffness to the extension member 21.

The dimensions of the extension member 21 are chosen such that when the deformed portion 24 abuts against stop means 16, the hoop 20 will be substantially in a vertical position at the limit of the upward travel of the extension member 21. The deformed portion 24 also must be placed so that it does not interfere with hoop 20 assuming such vertical position. Provided adjacent to each side of the recess 17 of the hoop 20 are bust portions 27 of the hoop 20 simulating the female form.

It can easily be seen that since my construction is relatively inexpensive, a number of them may be purchased by the average retail establishment and attached to the hanger 11 or other means and left attached in its collapsed condition until the dress is taken off the rack or storage means for display to the customer. When it is desired to display the dress or other items, the salesperson will simply grasp hanger 11 in one hand and pull the tab 26 with the other hand to expand the hoop 20 to its vertical position to display dress 12. If the customer desires to try the dress on, the reverse procedure is followed to collapse my portable mannequin so that the hook means 14 may be removed from the hanger 11, and the mannequin may be slipped out through the top or bottom of the dress and the dress given to the customer to try on.

On the other hand, if the customer does not like the dress, the portable mannequin may be also collapsed and the dress simply placed back on the rack, taking no more space for storage than if my portable mannequin device was not present.

Figure 7:
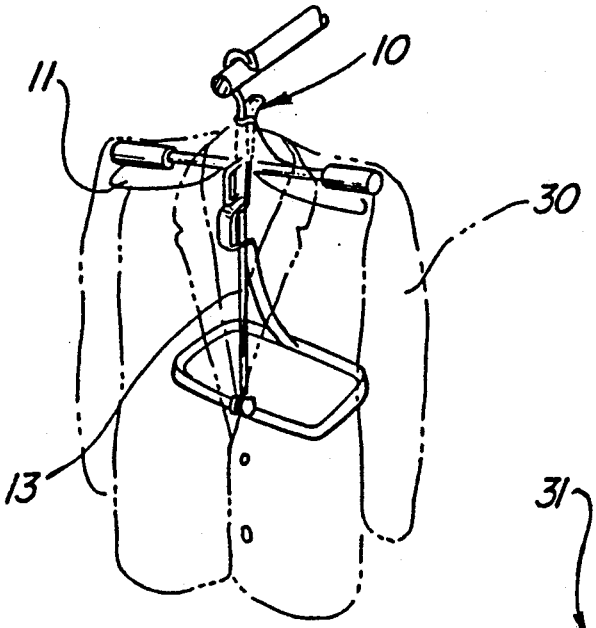
FIG. 7 is a view similar to that shown in FIG. 1, but showing from the front a construction embodying my invention attached to a coat hanger having a man's suit thereon, and being in its expanded position to simulate the suit being worn on the male figure.

Referring now to FIGS. 7 and 8, as previously mentioned, my invention can also be used for the display of men's clothing and the like. As before, there is shown my portable mannequin 10 attached to a coat hanger 11. As previously described, there is a frame member 13 having a hook means 14 at one end thereof and an eye 15 at the other end thereof. There is a stop means 16 intermediate the hook means 14 and the eye 15. The eye 15 snaps into a recess 17 in the thickened portion 18 of the hoop 20. In this case, the hoop 20 is shaped to simulate the male chest, rather than the female chest, and thus does not have portions 27 thereon.

As before, the hoop 20 has an extension member 21 attached to the body of the hoop through the hinge 22. Since the use of the living hinge 22A is preferred to attach the hinge 22 to the hoop 20, as before, the hoop and the hinge are preferably made of the same material and should be somewhat flexible. Formed in the extension portion 21 is a deformed portion 24 having a pair of axially aligned openings 25 therein by which the extension portion 21 may slide up and down on the frame member 13. A tab 26 is again provided on the extremity of the extension member 21 for ease of movement. As shown in FIG. 7, a suit 30 is shown being displayed on the hanger 11 by means of my portable mannequin 10.

Referring still to FIG. 8, there is shown an attachment for my portable mannequin which may be used with either the version shown in FIG. 1, or the version shown in FIG. 7, when an article of clothing is being displayed requiring an enhanced showing of the shoulder portion thereof. The shoulder attachment, generally designated by the numeral 31, consists of a central portion 32 having a padded portion 33 at either end thereof. Proximate the middle of the central portion 32 is an opening 34, elongated, if needed, so that the shoulder attachment 31 may be slipped over the hook means 14 and slid down on the frame member 31 until it comes to a stop against the stop means 16.

It can be seen that as the extension member 21 is slid along the frame member 13 to raise the hoop 20 to a substantially vertical position, the shoulder attachment 31 remains in a fixed position by the stop means 16.

It has been found to be desirable in some applications to which my construction is put to provide two modifications to the invention. The first of these is shown in FIG. 10, wherein an upper portion 40 of the frame member 13 is bent forward, producing an elbow in the frame member 13 indicated by the numeral 41. In this case, the previously described stop means 16 is replaced by the modified stop means 42.

The purpose of the bent forward upper portion 40 becomes evident when the modified portable mannequin 10 is hung on a coat hanger 11. Because of the bent forward upper portion 40, the hoop 20 is extended in a more forward direction in operation, thereby extending the bust portion of the dress 12 more than with the previously described modification of my invention.

Referring now to FIGS. 12–14, it has been found desirable in some applications to provide for increased friction as the hoop extension member is raised and lowered along the frame member 13. This is provided by the tubular member 43 which may be made of flexible plastic tubing, or the like, to be provided over the frame member 13 and be trapped between the walls of the deformed portion 24 of the extension member 21. If the length of the tubular member 43 is made slightly greater than the space available between the walls of the deformed portion 24, the tubular member 43 will be bent slightly, and pressure by the inside walls thereof against the frame member 13 will provide the necessary friction. As before, openings 25 having notches 25A are provided in the deformed portion 24 to provide for mounting of the hoop extension member 21.

Thus, it can be seen that I have provided a novel, portable mannequin which is both collapsible and attachable to the normal coat hanger without any modification to said coat hanger, and is significantly less expensive and simpler to use than any other mannequin-type device of which I am aware.

I claim:

1. A portable mannequin including, in combination:

(a) a separate clothes hanger;

(b) a frame member having hook means cooperating with said clothes hanger for removeably attaching said frame member to said clothes hanger, said frame member having said hook means on an upper portion thereof which is bent in a forward direction;

(c) a hoop pivotally mounted to said frame member; and (d) a hoop extension member connected at one end to said hoop and slideably connected at its other end to said frame member to open and close said hoop.

2. The device defined in claim 1, wherein said frame member has said hook means at one end thereof, an eye at the other end thereof pivotally engaging said hoop and a stop means intermediate said hook means and said eye, with said hoop extension member connected to said hoop opposite said eye.

3. The device defined in claim 2, wherein said extension member is hingedly connected to said hoop by a living hinge substantially opposite said eye.

4. The device defined in claim 3, wherein said extension member is slideably connected to said frame member by a deformed portion thereof, said deformed portion having a pair of axially aligned holes therein through which said frame member passes, and forming at least two walls on said extension member and a tubular member provided over said frame member and constrained between the walls of said deformed portion of said extension member for frictional engagement with said frame member.

5. The device defined in claim 4, wherein said deformed portion acts in combination with said stop means to limit the travel of said extension member.

6. The device defined in claim 5, and further including a tab means provided on said extension member above said deformed portion.

7. The device defined in claim 6, wherein said hoop is shaped to simulate the female form.

8. The device defined in claim 6, wherein said hoop is shaped to simulate the male form.

9. The device defined in claim 6, and including a shoulder attachment removeably attached to said frame member.

10. The device defined in claim 3, wherein said extension member is slideably connected to said frame member by a deformed portion thereof, said deformed portion having a pair of notches therein through which said frame member passes.

11. The device defined in claim 1, wherein said hoop extension member is made of millenery bone.

12. The device defined in claim 1, wherein said hoop extension member is of an all-plastic construction.

13. The device defined in claim 1, and including a hinge connected to said hoop and to said hoop extension member by a living hinge having a plurality of nibs thereon to receive said hoop extension member.

* * * * *